US008392197B2

(12) United States Patent
Hosokawa

(10) Patent No.: US 8,392,197 B2
(45) Date of Patent: Mar. 5, 2013

(54) SPEAKER SPEED CONVERSION SYSTEM, METHOD FOR SAME, AND SPEED CONVERSION DEVICE

(75) Inventor: Satoshi Hosokawa, Tokyo (JP)

(73) Assignee: NEC Corporation, Tokyo (JP)

( * ) Notice: Subject to any disclaimer, the term of this patent is extended or adjusted under 35 U.S.C. 154(b) by 483 days.

(21) Appl. No.: 12/672,230

(22) PCT Filed: Jul. 22, 2008

(86) PCT No.: PCT/JP2008/063128

§ 371 (c)(1),
(2), (4) Date: Feb. 4, 2010

(87) PCT Pub. No.: WO2009/025142

PCT Pub. Date: Feb. 26, 2009

(65) Prior Publication Data

US 2011/0224990 A1 Sep. 15, 2011

(30) Foreign Application Priority Data

Aug. 22, 2007 (JP) ..... 2007-215353

(51) Int. Cl.
*G10L 11/00* (2006.01)
*G10L 21/00* (2006.01)

(52) U.S. Cl. ..... 704/278

(58) Field of Classification Search ..... 704/278, 704/211

See application file for complete search history.

(56) References Cited

U.S. PATENT DOCUMENTS 5,694,521 A * 12/1997 Shlomot et al. ..... 704/262
5,752,226 A * 5/1998 Chan et al. ..... 704/233
5,828,994 A * 10/1998 Covell et al. ..... 704/211
6,490,553 B2 * 12/2002 Van Thong et al. ..... 704/211
6,999,922 B2 * 2/2006 Boillot et al. ..... 704/216
7,957,960 B2 * 6/2011 Chen ..... 704/211

FOREIGN PATENT DOCUMENTS

JP 2000-322061 A 11/2000
JP 2001-005500 A 1/2001
JP 2006-038956 A 2/2006
JP 2006-064755 A 3/2006
JP 2006-126372 A 5/2006
JP 2007-003682 A 1/2007
JP 2008-203421 A 9/2008
WO 2006/077626 A 7/2006

OTHER PUBLICATIONS

International Search Report for PCT/JP2008/063128, mailed Nov. 4, 2008.

* cited by examiner

*Primary Examiner* — Talivaldis Ivars Smits
*Assistant Examiner* — Shaun Roberts

(57) ABSTRACT

A speaker speed conversion system includes: a risk site detection unit (22) for detecting sites of risk regarding sound quality from among speech that is received as input, a frame boundary detection unit (23) for searching for a plurality of points that can serve as candidates of frame boundaries from among speech that is received as input and, of these points, supplying as a frame boundary the point that is predicted to be best from the standpoint of sound quality, and an OLA unit (25) for implementing speed conversion based on the detection results in the frame boundary detection unit (23); wherein the frame boundary detection unit (23) eliminates, from candidates of frame boundaries, sites of risk regarding sound quality that were detected in the risk site detection unit (22).

6 Claims, 7 Drawing Sheets

SPEAKER SPEED CONVERSION SYSTEM, METHOD FOR SAME, AND SPEED CONVERSION DEVICE

TECHNICAL FIELD

The present invention relates to a speaker speed conversion system and method, as well as to a speed conversion device, and more particularly, relates to a speaker speed conversion system and method as well as a speed conversion device for slowing the speed of a speaker's speech.

BACKGROUND ART

The OLA (OverLap and Add) method is typically employed as one example of speed conversion that does not change pitch.

FIG. 1A shows an example of the operation of speech conversion in a related speaker speed conversion system, and shows the original waveform of speech before conversion. FIG. 1B shows an example of the operation of speed conversion in a related speaker speed conversion system, and shows the waveform of speech after conversion. In FIGS. 1A and 1B, the horizontal axis is time (sec) and the vertical axis is output voltage (V).

When converting the speed of speech, simply converting the reproduction speed causes the pitch to change and therefore does not produce speech correctly. As a result, in OLA, the reproduction time is expanded with pitch maintained unchanged by increasing the speech waveform as shown below.

(1) The speech waveform is divided into frames as shown in FIG. 1A at appropriate locations (such as at zero-cross points). In FIG. 1A, for example, frames are divided into five frames at locations of crossing zero. Although one frame is taken as one period in FIG. 1A, this method is not limited to this form, and one frame can be two periods or more.

(2) As shown in FIG. 1B, frames are repeated at an ideal frequency according to a predetermined expansion ratio. In FIG. 1B, for example, frames 1, 3, and 4 are each repeated one time.

(3) As shown in FIG. 1B, a cross-fade process is implemented before and after the repeated portions to smoothly connect the waveform of portions in which frames are repeated. In FIG. 1B, for example, the cross-fade process is applied before and after the boundary of frame 1 and frame 1, the boundary of frame 3 and frame 3, and the boundary of frame 4 and frame 4. The cross fade process is not necessary as the OLA method, but is typically carried out as a method for improving sound quality.

The related art is disclosed in JP-A-2006-038956, JP-A-2007-003682, JP-A-2006-126372, and JP-A-2000-322061.

When frame boundary detection by zero-cross or a correlation function is used, however, the problem arises in which sound quality deteriorates at sites having many high regions such as at the beginnings of words.

When frame boundary detection based on pitch detection is used, the problem arises in which frame detection is unstable at sites where pitch becomes unstable, and an OLA process of such portions results in a breakdown in sound quality.

DISCLOSURE OF THE INVENTION

It is an object of the present invention to provide a speaker speed conversion system and method as well as a speed conversion device for solving the above-described problems and thus provide superior sound quality.

The present invention for achieving the above-described object is a speaker speed conversion system that includes a speed conversion means for converting the speed of speech that is received as input, the speed conversion means comprising: risk site detection means for detecting sites of risk regarding sound quality among the speech that is received as input;

frame boundary detection means for searching for a plurality of points that can serve as candidates for frame boundaries in speech that is received as input, and of these points, supplying as a frame boundary the point that is predicted to be the best in terms of sound quality; and OLA (overlap and add) means for performing speed conversion based on the detection results in the frame boundary detection means;

wherein the frame boundary detection means eliminates, from candidates of frame boundaries, sites of risk regarding sound quality that were detected in the risk site detection means.

In addition, the present invention is a speaker speed conversion system that includes a speed conversion means for converting the speed of speech that is received as input, the speed conversion means including:

risk site detection means for detecting sites of risk regarding sound quality among speech that is received as input;

repetition number determination processing means for determining the number of frame repetitions in an OLA (overlap and add) process of speech that is received as input; and an OLA (overlap and add) means for performing speed conversion based on the number of frame repetitions that was determined in the repetition number determination processing means;

wherein the repetition number determination processing means eliminates, as objects of the determination of the number of frame repetitions, sites of risk regarding sound quality that were detected in the risk site detection means.

Still further, the present invention is a speaker speed conversion method for converting the speed of speech that is received as input, the method including:

a risk site detection step of detecting sites of risk regarding sound quality among speech that is received as input;

a frame boundary detection step of detecting a plurality of points that can serve as candidates of frame boundaries from among speech that is received as input, and, of these points, supplying as a frame boundary the point that is predicted to be the best in terms of sound quality; and an OLA (overlap and add) step of performing speed conversion based on the detection results of the frame boundary detection step;

wherein the frame boundary detection step eliminates, from candidates of frame boundaries, sites of risk regarding sound quality that were detected in the risk site detection step.

In addition, the present invention is a speaker speed conversion method for converting the speed of speech that is received as input, the method including:

a risk site detection step of detecting sites of risk regarding sound quality among speech that is received as input;

a repetition number determination processing step of determining the number of frame repetitions in an OLA (overlap and add) process of speech that is received as input; and an OLA (overlap and add) step of performing speed conversion based on the number of frame repetitions that was determined in the repetition number determination processing step;

wherein the repetition number determination processing step eliminates, from objects of the determination of the number of frame repetitions, sites of risk regarding sound quality that were detected in the risk site detection step.

Still further, the present invention is a speaker speed conversion device for converting the speed of speech that is received as input, the speaker speed conversion device including:

a risk site detection means for detecting sites of risk regarding sound quality among speech that is received as input;

a frame boundary detection means for searching for a plurality of points that can serve as candidates of frame boundaries among speech that is received as input, and, of these points, supplying as a frame boundary the point that is predicted to be the best in terms of sound quality; and OLA (overlap and add) means for performing speed conversion based on the detection results in said frame boundary detection means;

wherein the frame boundary detection means eliminates, from candidates of frame boundaries, sites of risk regarding sound quality that were detected in the risk site detection means.

Still further, the present invention is a speaker speed conversion device for converting speed of speech that is received as input; the speaker speed conversion device including:

risk site detection means for detecting sites of risk regarding sound quality among speech that is received as input;

repetition number determination processing means for determining the number of frame repetitions in an OLA (overlap and add) process of speech that is received as input; and OLA (overlap and add) means for performing speed conversion based on the number of frame repetitions that was determined in the repetition number determination processing means;

wherein the repetition number determination processing means eliminates, from objects of determination of the number of frame repetitions, sites of risk regarding sound quality that were detected in the risk site detection means.

Finally, the present invention is a program for converting speed of speech that is received as input, the program causing a computer to execute:

a risk site detection step of detecting sites of risk regarding sound quality among speech that is received as input;

a frame boundary detection step of searching for a plurality of points that can serve as candidates of frame boundaries from among speech that is received as input and, of these points, supplying as a frame boundary the point that is predicted to be the best in terms of sound quality, and eliminating, from candidates of frame boundaries, sites of risk regarding sound quality that were detected in the risk site detection step;

a repetition number determination processing step of determining a number of frame repetitions in an OLA (overlap and add) process of speech that is received as input, and further, eliminating, as objects of the determination of the number of frame repetitions, sites of risk regarding sound quality that were detected in the risk site detection step; and an OLA (overlap and add) step of performing speed conversion based on the detection results of the frame boundary detection step and the number of frame repetitions that was determined in the repetition number determination processing step.

According to the present invention, a speaker speed conversion system and method as well as a speed conversion device are obtained that solve the above-described problems and thus provide superior sound quality.

BEST MODE FOR CARRYING OUT THE INVENTION

An ideal embodiment of the present invention is next described while referring to the accompanying figures.

Figure 2:
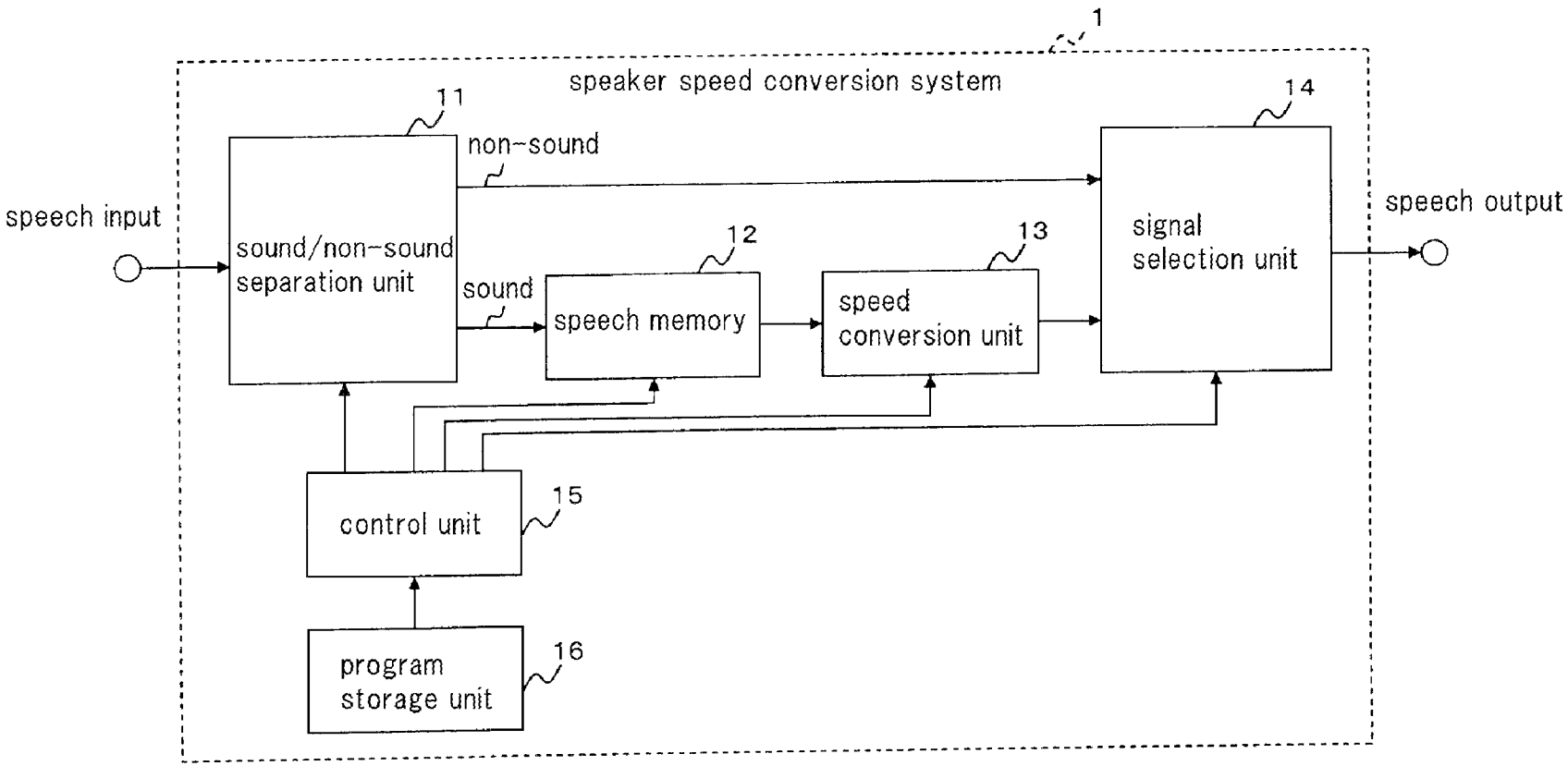
FIG. 2 is a block diagram of an ideal embodiment of the speaker speed conversion system according to the present invention.

FIG. 2 is a block diagram of an ideal embodiment of the speaker speed conversion system according to the present invention.

Referring to FIG. 2, an ideal embodiment of speaker speed conversion system 1 according to the present invention is configured to include: sound/non-sound separation unit 11, speech memory 12, speed conversion unit 13, signal selection unit 14, control unit 15, and program storage unit 16.

Sound/non-sound separation unit 11 determines whether the input speech is sound (a portion having meaning as information such human speech) or non-sound (a portion lacking meaning as information such as background noise) and then separates sound from non-sound. The determination of sound and non-sound is carried out at time intervals (for example, every 20 ms) and separation implemented for each time interval. As an example, determination is carried out according to the speech level (average value of amplitude of a fixed interval) or determination is carried out according to information relating to the information amount obtained from a speech decoder (a decoder such as an AMR [adaptive multi-rate] decoder arranged in a stage preceding speech input).

Speech memory 12 is a FIFO (First-In First-Out) memory for storing speech that has been determined as sound in sound/non-sound separation unit 11. A device constructed in RAM (Random Access Memory) realized by a ring buffer is typical.

Speed conversion unit 13 carries out an acoustic process for changing only the speed without changing the pitch of the speech. This part is the heart of the present invention. Speed conversion unit 13 operates only when speech is stored in speech memory 12.

Signal selection unit 14 supplies a sound signal when a sound signal is being supplied in the order of the sound route, i.e., in the order of sound/non-sound separation unit 11, speech memory 12, and speed conversion unit 13, and supplies a non-sound signal when a sound signal is not being supplied.

A predetermined program that will be described hereinbelow is stored in program storage unit 16.

Control unit 15 controls sound/non-sound separation unit 11, speech memory 12, speed conversion unit 13, and signal selection unit 14 based on the program that is stored in program storage unit 16.

An example of the configuration of speed conversion unit 13 is next described.

Figure 3:
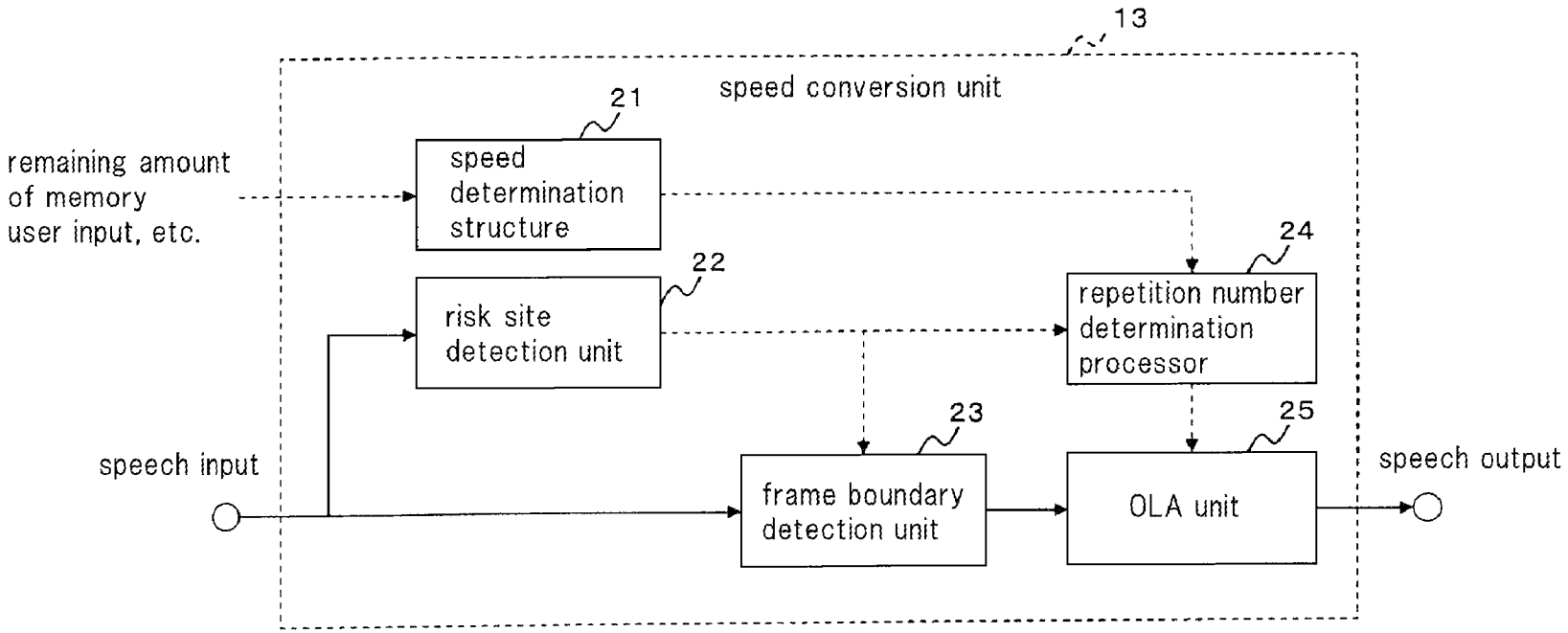
FIG. 3 is a block diagram of an example of the speed conversion unit of the speaker speed conversion system shown in FIG. 1.

FIG. 3 is a block diagram of an example of speed conversion unit 13 of the speaker speed conversion system shown in FIG. 1. It is assumed that speed conversion unit 13 in the present invention uses OLA.

Referring to FIG. 3, the example of speed conversion unit 13 is configured to include speed determination structure 21, risk site detection unit 22, frame boundary detection unit 23, repetition number determination processor 24, and OLA unit 25.

Speed determination structure 21 determines the expansion ratio of the OLA process based on, for example, the information shown below.

(1) The remaining amount of data of speech memory 12. When sound continues, the remaining amount of data of the speech memory increases monotonically. This happens due to the direction of expansion. On the other hand, because the data storage amount of speech memory 12 is limited, the expansion ratio must be suppressed when at least a fixed amount is stored.

(2) User operation information. When a function for controlling the expansion ratio is offered to the user, the user alters the expansion ratio according to information that is applied as input by, for example, operating a button.

Risk site detection unit 22 detects, of speech that is received as input, portions that have a possibility of becoming low-quality output (for example, the occurrence of discordant discontinuous components) through the application of the OLA process.

Frame boundary detection unit 23 detects the boundaries of sound frames that are used in the OLA process. In addition to detecting characteristics from the speech that is received as input, frame boundary detection unit 23 implements detection based on the risk site information that was obtained from risk site detection unit 22.

Repetition number determination processor 24 determines the number of frame repetition processes by OLA based on information from speed determination structure 21 and risk site detection unit 22. Repetition number determination processor 24 determines the number of repetitions as shown below for each frame that was detected by frame boundary detection unit 23.

(1) The expansion ratio determined in speed determination structure 21 is compared with an actual expansion ratio such as an expansion ratio calculated from the history of the number of repetitions that occurred in a one second period in the past, and the number of repetitions is set to "2" when the actual expansion ratio is lower. When the separation of the expansion ratios is great at this time, the number of repetitions may be set to "3" or more.

(2) When the ratio of risk sites in frames (obtained from risk site detection unit 22) exceeds a fixed threshold value, the repetition number is set to "1" regardless of the result of (1). The threshold value may be "0," and in this case the number of repetitions becomes "1" if even one risk site occurs in a frame.

Figure 1A:
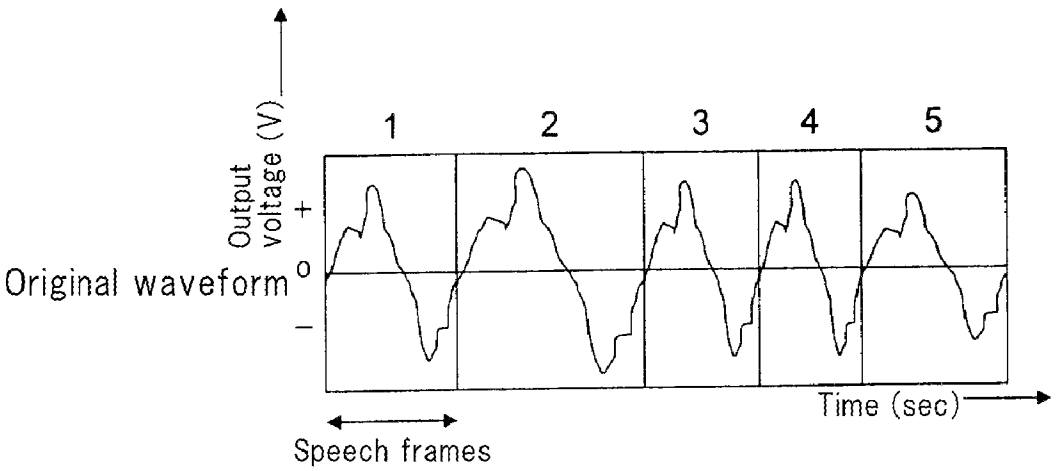
FIG. 1A shows an example of the speed conversion operation in a related speaker speed conversion system.
Figure 1B:
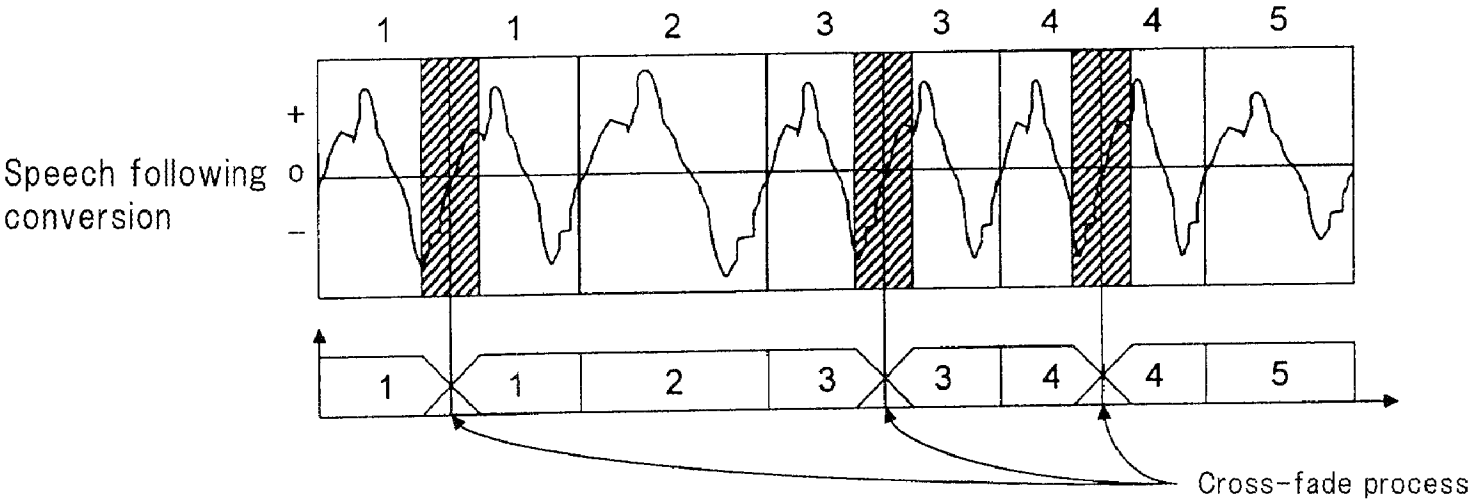
FIG. 1B shows an example of the speed conversion operation in a related speaker speed conversion system.

The operation of OLA unit 25 is as described using FIGS. 1A and 1B.

An example of the configuration of risk site detection unit 22 is next described.

Figure 4:
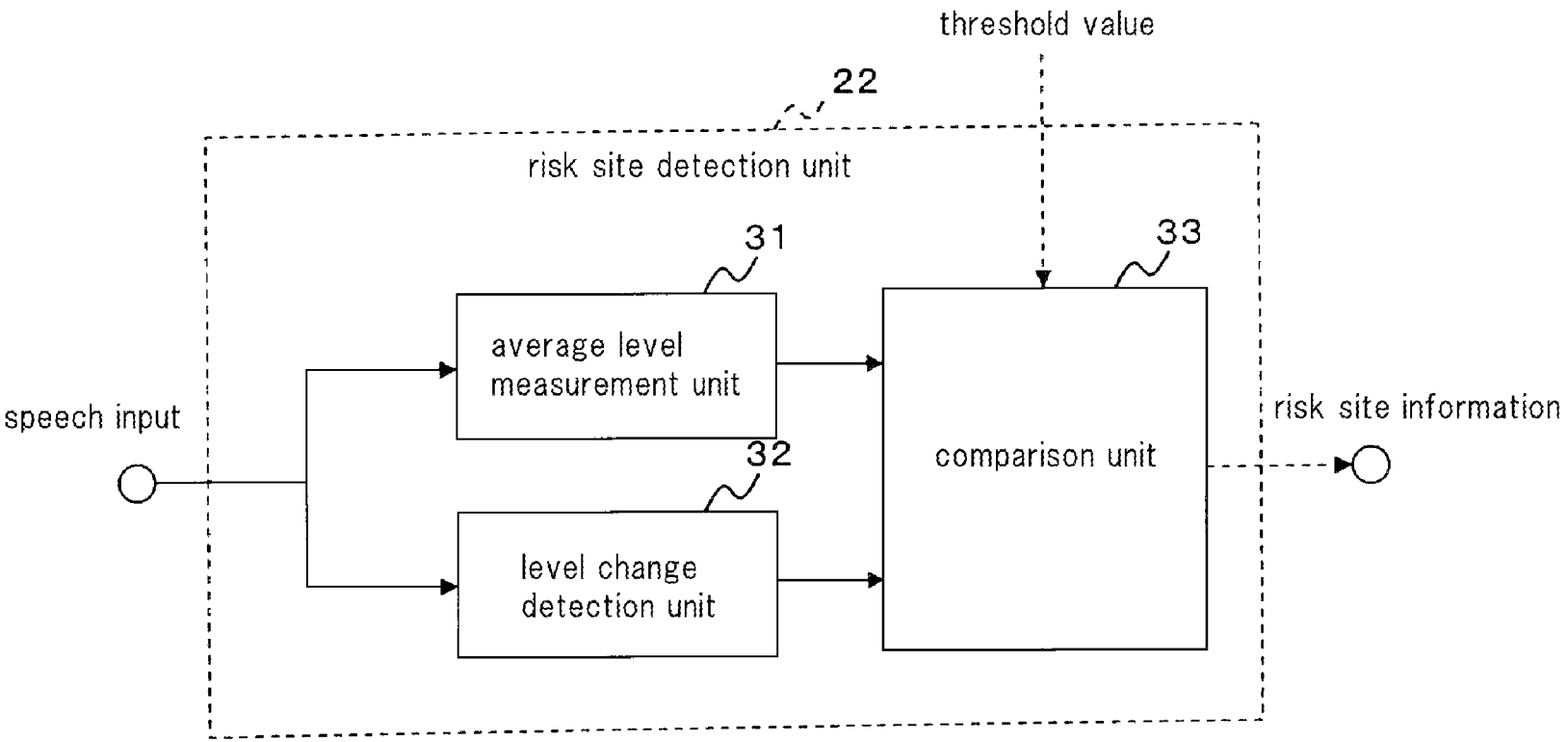
FIG. 4 is a block diagram of an example of the risk site detection unit shown in FIG. 3.

FIG. 4 is a block diagram of one example of risk site detection unit 22 shown in FIG. 3.

The configuration shown in FIG. 4 is an example configured to consider as risk sites, of the speech that is received as input, attack components, which are portions in which steep amplitude increase occurs such as at word beginnings, and, upon detection, to supply these attack components as risk sites. Various configurations other than the configuration shown in FIG. 4 can be considered as the configuration of risk site detection unit 22.

Referring to FIG. 4, an example of risk site detection unit 22 is made up from average level measurement unit 31, level change detection unit 32, and comparison unit 33.

Average level measurement unit 31 finds and supplies the average over time of the amplitude of speech input. For example, a value is obtained by averaging the absolute value of amplitude before and after a 0.5 second interval.

Level change detection unit 32 finds and supplies as output the change in amplitude. For example, level change detection unit 32 calculates the maximum value of the amplitude absolute value for each short time interval (for example, 50 ms), and then finds the change in amplitude by means of a method that finds the change over time of the maximum value. A time constant shorter than the average level measurement is used to enable detection of instantaneous changes.

Comparison unit 33 divides the output value of level change detection unit 32 by the output value of average level measurement unit 31, and compares the result of division with a predetermined threshold value. If the division result surpasses the threshold value, comparison unit 33 supplies risk site information indicating that the attack component is a risk site.

Figure 5:
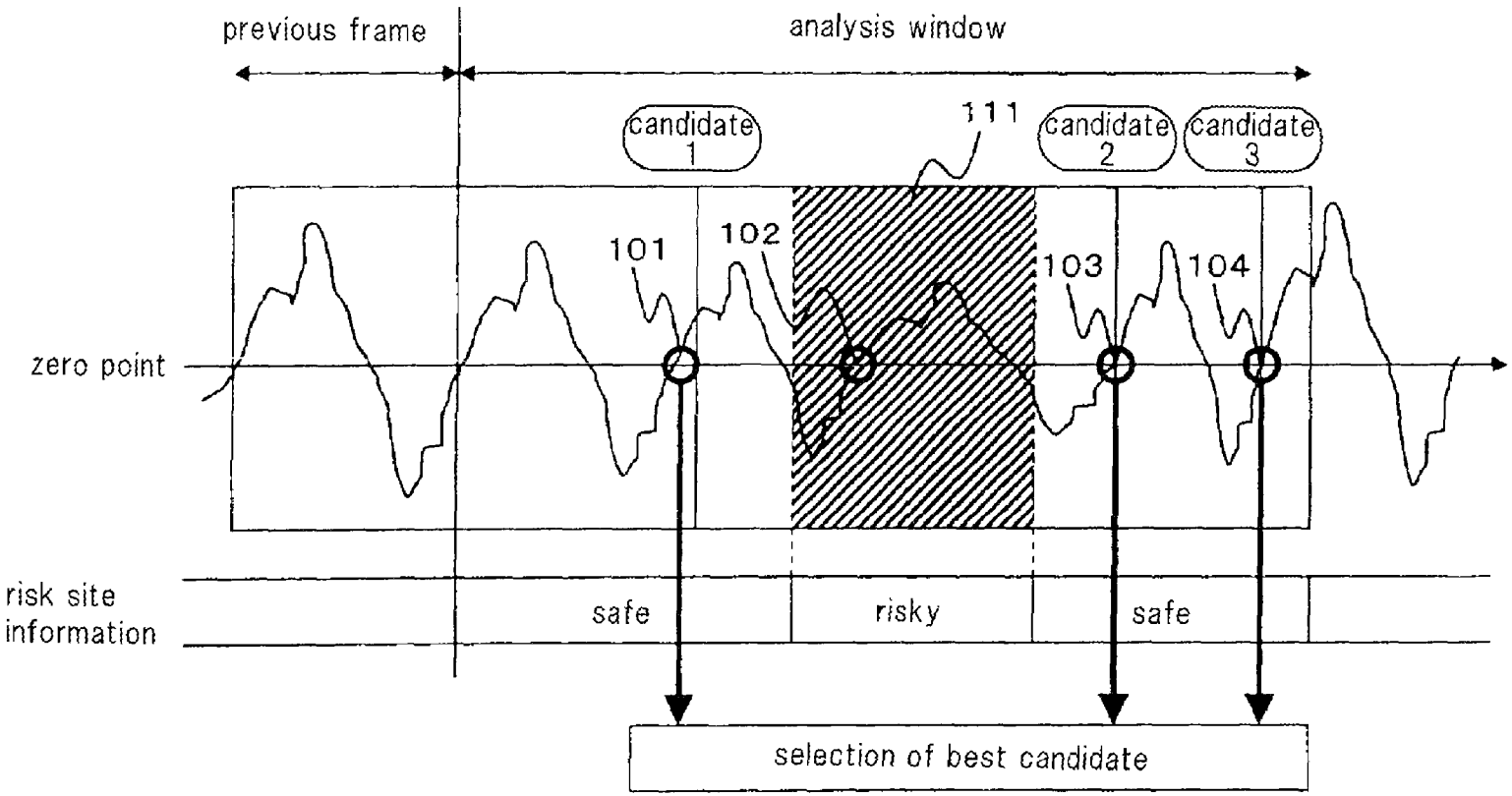
FIG. 5 is a speech waveform chart showing an example of the operation of the speaker speed conversion system shown in FIGS. 2-4.
Figure 6:
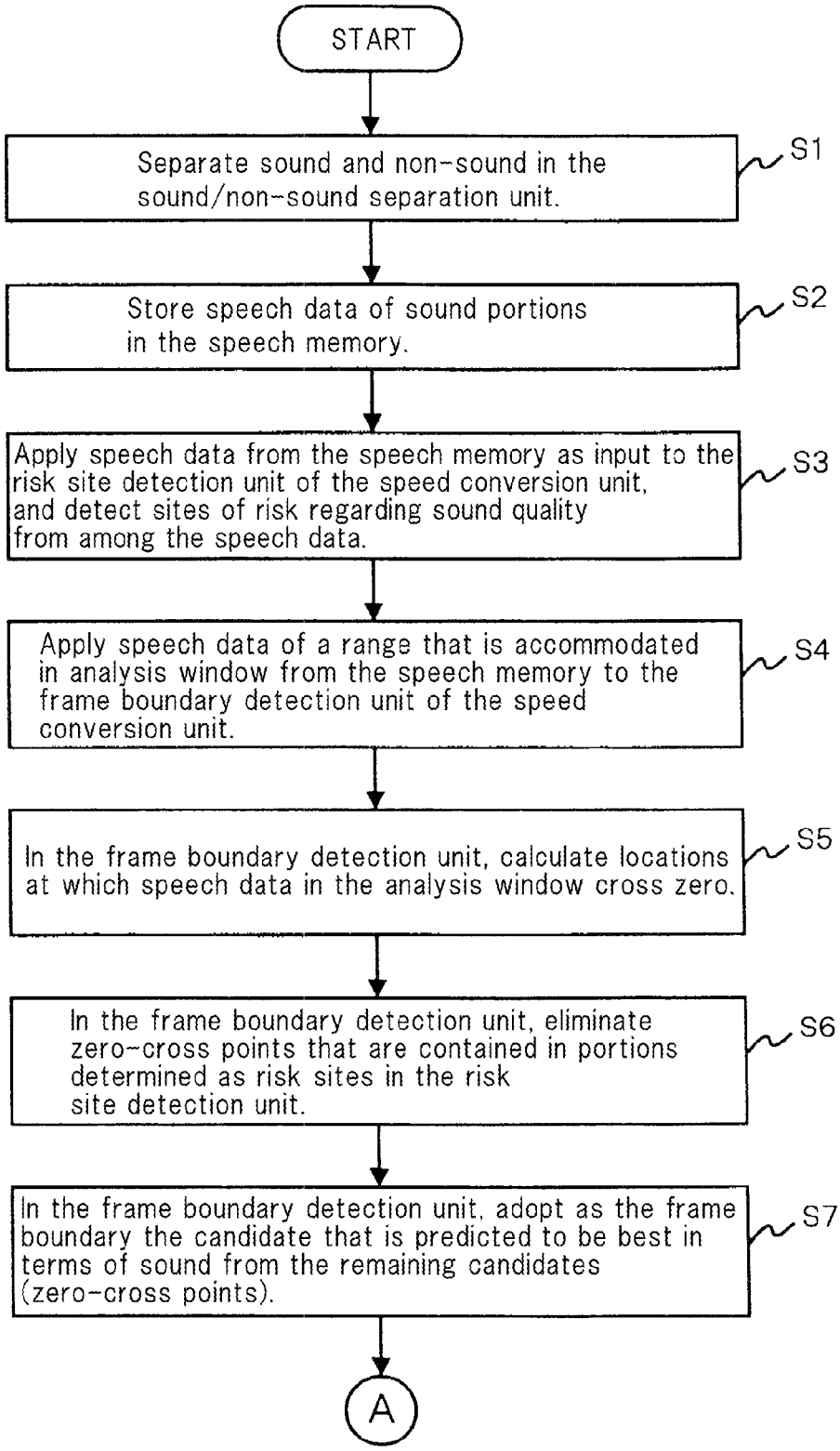
FIG. 6 is a flow chart showing an example of the operation of the speaker speed conversion system shown in FIGS. 2-4.
Figure 7:
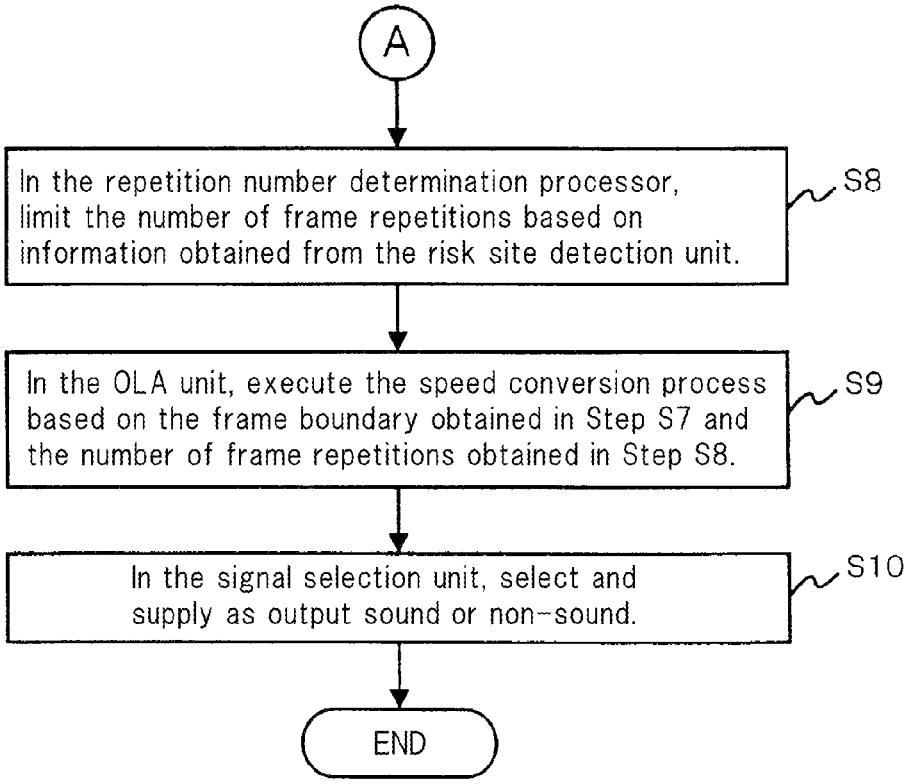
FIG. 7 is a flow chart showing an example of the operation of the speaker speed conversion system shown in FIGS. 2-4.

Explanation next regards the operation of an ideal embodiment of the present invention with reference to FIGS. 5-7.

FIG. 5 is a speech waveform chart showing an example of the operation of the speaker speed conversion system shown in FIGS. 2-4, and FIGS. 6 and 7 are flow charts showing an example of the operation of the speaker speed conversion system shown in FIGS. 2-4.

Program storage unit 16 stores the speaker speed conversion program shown in the flow charts of FIGS. 6 and 7. Control unit 15 that is constituted by a computer reads the program from program storage unit 16 and controls sound/non-sound separation unit 11, speech memory 12, speed conversion unit 13, and signal selection unit 14 in accordance with the program. The content of this control is next described.

Sound and non-sound are first separated in sound/non-sound separation unit 11 in Step S1.

Next, the speech data of the sound portion is stored in speech memory 12 in Step S2.

In Step S3, speech data from speech memory 12 are next applied as input to risk site detection unit 22 of speed conversion unit 13 and sites of risk regarding sound quality are detected from the speech data in risk site detection unit 22. As described hereinabove, risk sites regarding sound quality refer to portions in which there are steep increases in the amplitude of word beginnings.

In Step S4, speech data of a range that is accommodated within an analysis window is applied as input from speech memory 12 to frame boundary detection unit 23 of speed conversion unit 13.

In frame boundary detection unit 23, a frame boundary detection operation is carried out from immediately after the previously detected frame. More specifically, an analysis window of a fixed time interval portion is prepared and analysis is carried out for speech data of a range that is accommodated in the analysis window. This approach is adopted to limit processing time to a finite amount.

Frame boundary detection unit 23 searches for a plurality of points that can serve as candidates of frame boundaries from the speech data in the analysis window, and of these, supplies the point that is predicted to be the best in terms of sound quality as a frame boundary. This process is executed as described below.

Next, in Step S5, frame boundary detection unit 23 calculates locations at which the speech data in the analysis window cross zero. Crossing zero refers to points at which the output voltage value changes from minus to plus or changes from plus to minus.

Referring to FIG. 5, zero-cross points 101-104 are examples of locations at which speech data cross zero.

On the other hand, portion 111 that was determined to be a risk site in risk site detection unit 22 is shown by hatching by diagonal lines in FIG. 5.

In frame boundary detection unit 23, zero-cross point 102 that is contained in portion 111 that was determined to be a risk site is next removed from candidates of frame boundaries in Step S6.

Accordingly, candidates of frame boundaries for which processing has been implemented and that still remain at this point are candidate 1 (zero-cross point 101), candidate 2 (zero-cross point 103), and candidate 3 (zero-cross point 104).

In Step S7, the candidate of remaining candidates 1-3 (zero-cross points 101, 103, and 104) that is predicted to be the best in terms of sound quality is next taken as the frame boundary in frame boundary detection unit 23.

The process of Step S7 is implemented by comparing the speech waveform in the vicinity of the frame head portion (immediately following the frame that was previously detected) with the speech waveform in the vicinity of each candidate and then selecting the portion having the highest correlation (having similar waveform). This method is adopted because the speech at the head and tail of a frame is reproduced continuously when each frame is repeated by means of an OLA process.

There are several typical methods for finding correlation, such as a method of using a correlation function and a method of comparing codes of each sample.

As an example, when candidate 1 (zero-cross point 101) is taken as the frame boundary, the speech data of a single frame portion that begins from zero-cross point 101 become the object of repetition.

In Step S8, the number of repetitions of the frame is limited in repetition number determination processor 24 based on information that is obtained from risk site detection unit 22.

In Step S9, a speed conversion process is executed in OLA unit 25 based on the frame boundary obtained in Step S7 and the frame repetition number is obtained in Step S8.

In Step S10, sound data or non-sound data are selected in signal selection unit 14 and the selected data are supplied as output.

In limiting the number of repetitions in Step S8, the number of repetitions is suppressed in repetition number determination processor 24 based on information obtained from risk site detection unit 22, resulting in an operation in which reproduction speed speeds up in locations where the number of risk sites is comparatively high (attack portions) and slows down in locations where risk sites are comparatively few.

According to an ideal embodiment of the present invention as described hereinabove, eliminating sites of risk regarding sound quality as objects of the frame repetition process allows the realization of a speaker speed conversion system and method as well as a speed conversion device that feature high sound quality.

Further, avoiding sites of risk regarding sound quality in frame detection enables the realization of a speaker speed conversion system and method as well as a speed conversion device that feature high sound quality.

Adopting a mode of investigating the attack components of input speech in the detection of sites of risk regarding sound quality enables the realization of a speaker speed conversion system and method as well as speed conversion device that feature high efficiency and high sound quality.

Although the invention of the present application has been described with reference to an embodiment, the invention of the present application is not limited to the above-described embodiment. The configuration and details of the invention of the present application are open to various modifications within the scope of the invention that will be readily understood by one of ordinary skill in the art.

This application in the National Phase of PCT/JP2008/063128, filed on Jul. 22, 2008, which claims priority based on Japanese Patent Application 2007-215353 for which application was submitted on Aug. 22, 2007 and incorporates all of the disclosures of that application.

The invention claimed is:

1. A speaker speed conversion method for converting the speed of speech that is received as input, said method comprising:

a risk site detection step of detecting sites of risk regarding sound quality from among speech that is received as input;

a frame boundary detection step of detecting a plurality of points that can serve as candidates of frame boundaries from among speech that is received as input, and from among these points, supplying as a frame boundary the point that is predicted to be best in terms of sound quality; and an OLA (overlap and add) step of performing speed conversion based on the detection results of said frame boundary detection step;

wherein said frame boundary detection step eliminates, from candidates of frame boundaries, sites of risk regarding sound quality that were detected in said risk site detection step, and at least one of the risk site detection step, the frame boundary detection step, and the OLA step is performed by a computer.

2. The speaker speed conversion method according to claim 1, comprising a repetition number determination processing step of determining a number of frame repetitions in an OLA (overlap and add) process of speech received as input and eliminating, from objects of determination of the number of frame repetitions, sites of risk regarding sound quality that were detected in said risk site detection step;

wherein said OLA (overlap and add) step implements speed conversion based on detection results in said frame boundary detection step and the number of frame repetitions that was determined in said repetition number determination processing step.

3. The speaker speed conversion method according to claim 1, wherein said risk site detection step detects, from among speech received as input, portions in which steep amplitude increases of word beginnings occur as sites of risk.

4. A speaker speed conversion method for converting the speed of speech that is received as input, said method comprising:

a risk site detection step of detecting sites of risk regarding sound quality from among speech that is received as input;

a repetition number determination processing step of determining the number of frame repetitions in an OLA (overlap and add) process of speech that is received as input; and an OLA (overlap and add) step of performing speed conversion based on the number of frame repetitions that was determined in the repetition number determination processing step;

wherein said repetition number determination processing step eliminates, from objects of determination of the number of frame repetitions, sites of risk regarding sound quality that were detected in said risk site detection step, and at least one of the risk site detection step, the repetition number determination processing step, and the OLA step is performed by a computer.

5. The speaker speed conversion method according to claim 4, wherein said risk site detection step detects, from among speech received as input, portions in which steep amplitude increases of word beginnings occur as sites of risk.

6. A non-transitory computer-readable recording medium storing a program for converting speed of speech that is received as input, said program, when being executed by a computer, causes the computer to execute:

a risk site detection step of detecting sites of risk regarding sound quality from among speech that is received as input;

a frame boundary detection step of searching for a plurality of points that can serve as candidates of frame boundaries from among speech that is received as input and from among these points, eliminating, from candidates of frame boundaries, sites of risk regarding sound quality that were detected in said risk site detection step;

a repetition number determination processing step of determining a number of frame repetitions in an OLA (overlap and add) process of speech that is received as input, and further, eliminating, from objects of the determination of the number of frame repetitions, sites of risk regarding sound quality that were detected in said risk site detection step; and an OLA (overlap and add) step of performing speed conversion based on the detection results of said frame boundary detection step and the number of frame repetitions that was determined in said repetition number determination processing step.

* * * * *